US010581136B2

(12) United States Patent
Ushijima et al.

(10) Patent No.: US 10,581,136 B2
(45) Date of Patent: Mar. 3, 2020

(54) THREE-WAY POWER DIVIDER AND MULTIBEAM FORMING CIRCUIT

(71) Applicant: Mitsubishi Electric Corporation, Tokyo (JP)

(72) Inventors: Yu Ushijima, Tokyo (JP); Hidenori Yukawa, Tokyo (JP); Motomi Watanabe, Tokyo (JP); Naofumi Yoneda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/094,820

(22) PCT Filed: May 24, 2016

(86) PCT No.: PCT/JP2016/065289

§ 371 (c)(1),
(2) Date: Oct. 18, 2018

(87) PCT Pub. No.: WO2017/203597

PCT Pub. Date: Nov. 30, 2017

(65) Prior Publication Data

US 2019/0123414 A1 Apr. 25, 2019

(51) Int. Cl.

| | |
|---|---|
| ***H01P 5/16*** | (2006.01) |
| ***H01P 5/22*** | (2006.01) |
| ***H01P 5/18*** | (2006.01) |
| ***H01P 1/18*** | (2006.01) |

(52) U.S. Cl.

CPC ..... *H01P 5/16* (2013.01); *H01P 1/182* (2013.01); *H01P 5/182* (2013.01); *H01P 5/22* (2013.01)

(58) Field of Classification Search

CPC ..... H01P 5/16; H01P 5/22; H01P 5/182
USPC ..... 333/125
See application file for complete search history.

(56) References Cited

U.S. PATENT DOCUMENTS 3,678,415 A * 7/1972 Kuroda ..... H01P 5/227 333/117

OTHER PUBLICATIONS

Schneider et al., "Branch-line Couplers for Satellite Antenna Systems", Proceedings of the 6th German Microwave Conference, Darmstadt, Germany, 2011, 4 pages.

* cited by examiner

*Primary Examiner* — Robert J Pascal
*Assistant Examiner* — Kimberly E Glenn
(74) *Attorney, Agent, or Firm* — Birch, Stewart, Kolasch & Birch, LLP

(57) ABSTRACT

An input waveguide (6) having one end connected between an L-shaped waveguide (1*a*) and an L-shaped waveguide (1*f*) and another end connected to the PORT (1); an output waveguide (7) having one end connected between the L-shaped waveguide (1*a*) and a flat waveguide (1*b*) and another end connected to the PORT (2); an output waveguide (8) having one end connected between the flat waveguide (1*b*) and an L-shaped waveguide (1*c*) and another end connected to the PORT (3); an output waveguide (9) having one end connected between the L-shaped waveguide (1*c*) and an L-shaped waveguide (1*d*) and another end connected to the PORT (4); and a plurality of branching waveguides (10) each having one end connected to the output waveguide (7) and another end connected to the output waveguide (8) are provided.

8 Claims, 8 Drawing Sheets

THREE-WAY POWER DIVIDER AND MULTIBEAM FORMING CIRCUIT

TECHNICAL FIELD

The present invention relates to a three-way power divider for dividing power of an input signal into three and a multibeam forming circuit mounted with the three-way power divider.

BACKGROUND ART

As wireless communication performed in aircrafts or ships, wireless communication using high-speed communication satellites is increasing in recent years.

In order to cope with an increase in demand for wireless communication using high-speed communication satellites, it is necessary to reduce the size of a coverage area of a beam radiated from an antenna to efficiently radiate a radio wave to a narrow area. Moreover, in order to cover a whole service area, it is necessary to provide a large number of spot beams.

For making it possible to radiate a radio wave to a narrow area effectively in a state where a large number of spot beams are provided, a multibeam antenna method is known.

In the multibeam antenna method, a plurality of beams is formed by a multibeam antenna device, and the multibeam antenna device includes, in addition to a plurality of radiating elements and reflecting mirrors, a multibeam forming circuit for outputting signals to the radiating elements.

The multibeam forming circuit further includes a two-way power divider for dividing power of an input signal into two, a three-way power divider for dividing power of an input signal into three, and a phase shifter.

The number of mounted two-way power dividers and the number of mounted three-way power dividers vary depending on the number of output signals of the multibeam forming circuit. For example, there is a case in which two two-way power dividers and two three-way power dividers are mounted in one-beam forming circuit.

The following Non-Patent Literature 1 discloses a three-way power divider including one input port for receiving a signal and three output ports for respectively outputting signals.

In this three-way power divider, installation position of the one input port and installation positions of the three output ports are on opposite sides.

Specifically, assuming that the origin on an X-Y plane is, for example, at a center position of the three-way power divider, an installation position of the one input port is (0, −Y) on the X-Y plane and installation positions of the three output ports are (−X, Y), (0, Y), (X, Y) on the X-Y plane.

In addition, two terminators are connected to the three-way power divider.

CITATION LIST

Non-Patent Literature

Non-Patent Literature 1: M. Schneider, et. al., "Branch-line Couplers for Satellite Antenna Systems," Proc. GeMC2011, pp. 1-4, 2011.

SUMMARY OF INVENTION

Technical Problem

In a case where a plurality of three-way power dividers and a plurality of two-way power dividers are mounted on a multibeam forming circuit, by arraying the plurality of three-way power dividers and the plurality of two-way power dividers in the same direction as the aligned direction of the plurality of radiating elements, a length of the multibeam forming circuit in a direction orthogonal to the aligned direction of the plurality of radiating elements can be shortened. In the case of arraying them in the same direction as the aligned direction of the plurality of radiating elements, however, there is a problem that a wiring distance of a signal line connecting between the power dividers disadvantageously becomes long, since in a conventional three-way power divider one input port and three output ports are installed on opposite sides.

Specifically, in order to provide a divided signal output from an output port of a three-way power divider as an input signal to another three-way power divider, the output port of the former three-way power divider and the input port of the latter three-way power divider need to be connected by a signal line, and for example, assuming that the Y coordinate value of the output port of the former three-way power divider is −Y, the Y coordinate value of the input port of the latter three-way power divider is +Y, so that the wiring distance of the signal line becomes long.

In a conventional three-way power divider, there is another problem that it is necessary to connect two terminators.

The present invention has been made in order to solve the above problems, and an object of the present invention is to provide a three-way power divider that allows power of a signal to be divided into three without connecting a terminator, and a wiring distance of a signal line to be reduced when mounted in a multibeam forming circuit.

Another object of the present invention is to provide a multibeam forming circuit that allows a wiring distance of a signal line to be reduced.

Solution to Problem

A three-way power divider according to the present invention includes: a rectangular waveguide having a waveguide wall, the waveguide wall being formed by a first L-shaped waveguide, a first flat waveguide, a second L-shaped waveguide, a third L-shaped waveguide, a second flat waveguide, and a fourth L-shaped waveguide arranged in a ring shape; an input waveguide having one end connected between the first L-shaped waveguide and the fourth L-shaped waveguide and another end connected to a first port; a first output waveguide having one end connected between the first L-shaped waveguide and the first flat waveguide and another end connected to a second port; a second output waveguide having one end connected between the first flat waveguide and the second L-shaped waveguide and another end connected to a third port; a third output waveguide having one end connected between the second L-shaped waveguide and the third L-shaped waveguide, or between the second flat waveguide and the fourth L-shaped waveguide and another end connected to a fourth port; and a plurality of branching waveguides each having one end connected to the first output waveguide and another end connected to the second output waveguide.

Advantageous Effects of Invention

According to the present invention, a three-way power divider includes: a rectangular waveguide having a waveguide wall, the waveguide wall being formed by a first L-shaped waveguide, a first flat waveguide, a second L-shaped waveguide, a third L-shaped waveguide, a second flat waveguide, and a fourth L-shaped waveguide arranged in a ring shape; an input waveguide having one end connected between the first L-shaped waveguide and the fourth L-shaped waveguide and another end connected to a first port; a first output waveguide having one end connected between the first L-shaped waveguide and the first flat waveguide and another end connected to a second port; a second output waveguide having one end connected between the first flat waveguide and the second L-shaped waveguide and another end connected to a third port; a third output waveguide having one end connected between the second L-shaped waveguide and the third L-shaped waveguide, or between the second flat waveguide and the fourth L-shaped waveguide and another end connected to a fourth port; and a plurality of branching waveguides each having one end connected to the first output waveguide and another end connected to the second output waveguide. Due to such a configuration, power of a signal can be divided into three without connecting a terminator, and a wiring distance of a signal line when the three-way power divider is mounted on a multibeam forming circuit can be reduced.

DESCRIPTION OF EMBODIMENTS

To describe the invention in more detail, some embodiments for carrying out the present invention will be described below with reference to the accompanying drawings.

First Embodiment

Figure 1:
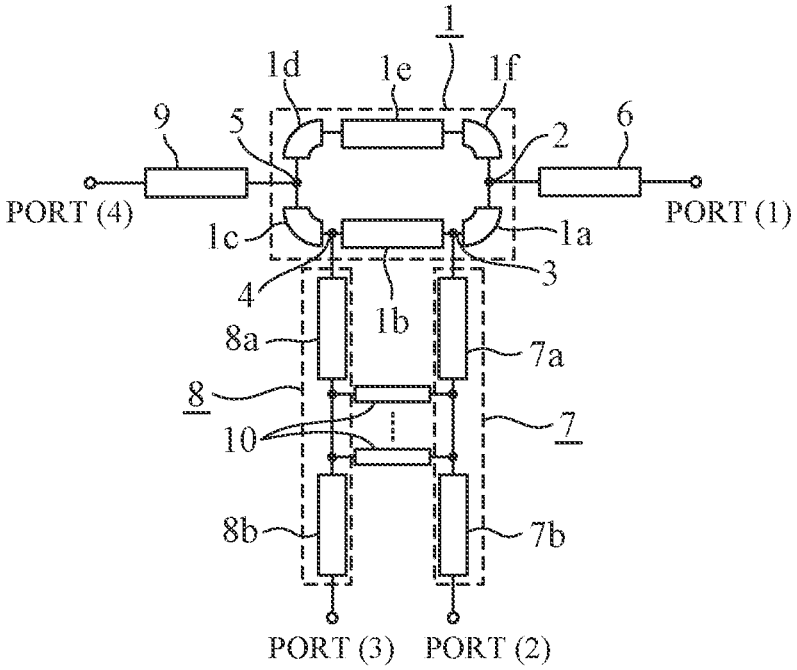
FIG. 1 is an equivalent circuit diagram illustrating a three-way power divider according to a first embodiment of the present invention.

FIG. 1 is an equivalent circuit diagram illustrating a three-way power divider according to a first embodiment of the present invention.

Figure 2:
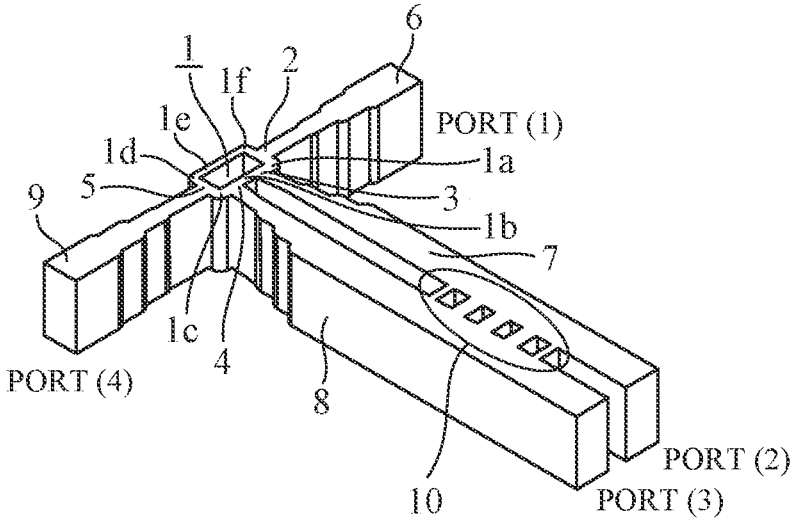
FIG. 2 is a perspective view illustrating the three-way power divider according to the first embodiment of the present invention.
Figure 3:
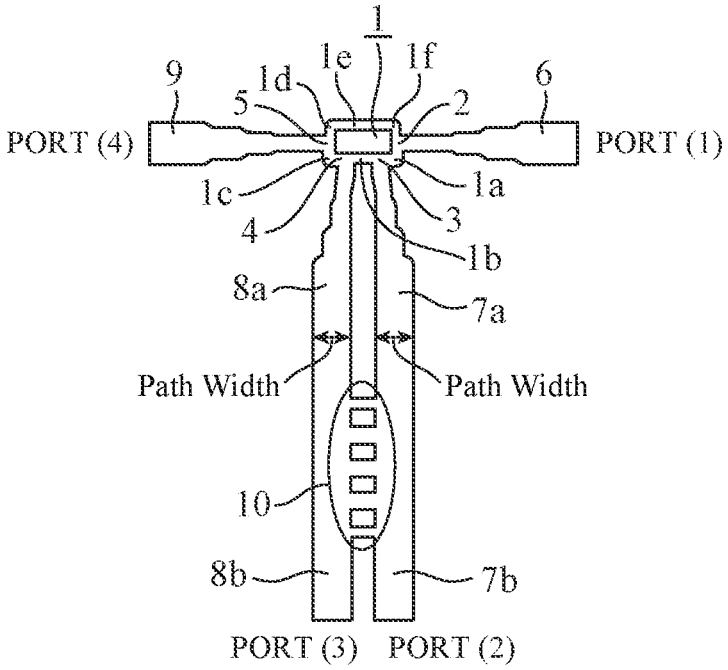
FIG. 3 is a top view illustrating the three-way power divider according to the first embodiment of the present invention.

FIG. 2 is a perspective view illustrating the three-way power divider according to the first embodiment of the present invention, and FIG. 3 is a top view illustrating the three-way power divider according to the first embodiment of the present invention.

In FIGS. 1, 2, and 3, the PORT (1) denotes a first port, the PORT (2) denotes a second port, the PORT (3) denotes a third port, and the PORT (4) denotes a fourth port.

A rectangular waveguide 1 has a waveguide wall formed by arranging an L-shaped waveguide 1*a*, a flat waveguide 1*b*, an L-shaped waveguide 1*c*, an L-shaped waveguide 1*d*, a flat waveguide 1*e*, and an L-shaped waveguide 1*f* in a ring shape.

The L-shaped waveguide 1*a* is a first L-shaped waveguide having an electrical length of $\lambda/4$ which is a quarter of the wavelength at a frequency of a fundamental wave of the propagating signal.

The flat waveguide 1*b* is a first flat waveguide having an electrical length of $\lambda/4$ which is a quarter of the wavelength at the frequency of the fundamental wave of the propagating signal.

The L-shaped waveguide 1*c* is a second L-shaped waveguide having an electrical length of $\lambda/4$ which is a quarter of the wavelength at the frequency of the fundamental wave of the propagating signal.

The L-shaped waveguide 1*d* is a third L-shaped waveguide having an electrical length of $\lambda/4$ which is a quarter of the wavelength at the frequency of the fundamental wave of the propagating signal.

The flat waveguide 1*e* is a second flat waveguide having an electrical length of $\lambda/4$ which is a quarter of the wavelength at the frequency of the fundamental wave of the propagating signal.

The L-shaped waveguide 1*f* is a fourth L-shaped waveguide having an electrical length of $\lambda/4$ which is a quarter of the wavelength at the frequency of the fundamental wave of the propagating signal.

A port 2 is provided between the L-shaped waveguide 1*a* and the L-shaped waveguide 1*f*.

A port 3 is provided between the L-shaped waveguide 1*a* and the flat waveguide 1*b*.

A port 4 is provided between the flat waveguide 1*b* and the L-shaped waveguide 1*c*.

A port 5 is provided between the L-shaped waveguide 1*c* and the L-shaped waveguide 1*d*.

One end of an input waveguide 6 is connected to the port 2 of the rectangular waveguide 1, and the other end thereof is connected to the PORT (1).

An output waveguide 7 is a first output waveguide including a waveguide 7*a* and a waveguide 7*b*.

One end of the waveguide 7*a* is connected to the port 3 of the rectangular waveguide 1. One end of the waveguide 7*b* is connected to the other end of the waveguide 7*a* and the other end of the waveguide 7*b* is connected to the PORT (2).

In the output waveguide 7, a part of the path width thereof in the vicinity of the port 3 becomes wider stepwise from the port 3 toward the PORT (2). In FIG. 3, the path width of the output waveguide 7 is the width in the lateral direction of the output waveguide 7.

An output waveguide 8 is a second output waveguide including a waveguide 8*a* and a waveguide 8*b*.

One end of the waveguide 8*a* is connected to the port 4 of the rectangular waveguide 1. One end of the waveguide 8*b* is connected to the other end of the waveguide 8*a* and the other end of the waveguide 8*b* is connected to the PORT (3).

In the output waveguide 8, a part of the path width thereof in the vicinity of the port 4 becomes wider stepwise from the port 4 toward the PORT (3). In FIG. 3, the path width of the output waveguide 8 is the width in the lateral direction of the output waveguide 8.

An output waveguide 9 is a third output waveguide having one end connected to the port 5 of the rectangular waveguide 1 and the other end connected to the PORT (4).

One end of a branching waveguide 10 is connected between the waveguide 7*a* and the waveguide 7*b*, and the other end thereof is connected between the waveguide 8*a* and the waveguide 8*b*.

In the example of FIGS. 2 and 3, the number of branching waveguides 10 is five; however, the number is not limited to five and may be increased or decreased depending on a power ratio of signals divided between the PORT (2) and the PORT (3).

Next, the operation will be described.

Figure 4:
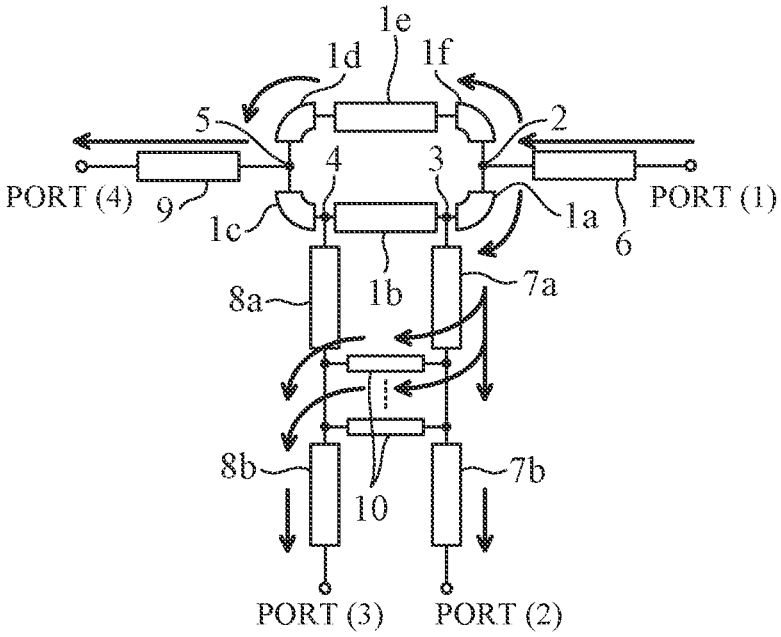
FIG. 4 is an explanatory diagram illustrating propagation directions of a signal input from the PORT (1)

FIG. 4 is an explanatory diagram illustrating a propagation direction of a signal input from the PORT (1). In the figure, each of the arrows indicates a propagation direction of the signal.

The power of the signal input from the PORT (1) is divided at the port 2 of the rectangular waveguide 1, and one piece of the divided power of the signal is propagated toward the L-shaped waveguide 1*a* while the other piece of the divided power of the signal is propagated toward the L-shaped waveguide 1*f*.

A power distribution ratio of the signals divided at the port 2 of the rectangular waveguide 1 is determined by the impedances of the respective waveguides.

The power of the signal propagated toward the L-shaped waveguide 1*a* is propagated toward the output waveguide 7 but not toward the flat waveguide 1*b*.

The reason why the power of the signal propagated toward the L-shaped waveguide 1*a* is not propagated toward the flat waveguide 1*b* is as follows.

The difference between the sum λ, of the electrical length λ/4 of each of the L-shaped waveguide 1*c*, the L-shaped waveguide 1*d*, the flat waveguide 1*e*, and the L-shaped waveguide 1*f*, and the sum λ/2 of the electrical length λ/4 of each of the L-shaped waveguide 1*a* and the flat waveguide 1*b* is λ/2 being half of the wavelength.

Therefore, at the port 4 of the rectangular waveguide 1, the phase of the signal propagated from the port 2 in the direction toward the L-shaped waveguide 1*a* and the phase of the signal propagated from the port 5 in the direction toward the port 4 are opposite to each other, and thus both signals cancel out each other.

The power of the signal propagated in the direction toward the output waveguide 7 is divided at a position between the waveguide 7*a* and the waveguide 7*b*, and one piece of the divided power of the signal is propagated toward the waveguide 7*b* and is output to the PORT (2).

The other piece of the divided power of the signal is propagated toward the output waveguide 8 via the plurality of branching waveguides 10. The power of the signal propagated toward the output waveguide 8 is propagated toward the waveguide 8*b* and is output to the PORT (3).

The power of the signal divided at the port 2 of the rectangular waveguide 1 and propagated in the direction toward the L-shaped waveguide 1*f* is propagated toward the output waveguide 9 and is output to the PORT (4).

Here, reflection and degree of coupling characteristics of the three-way power divider according to the first embodiment will be described.

FIG. 5 is an explanatory diagram illustrating reflection and degree of coupling characteristics of the three-way power divider according to the first embodiment.

Figure 5A:
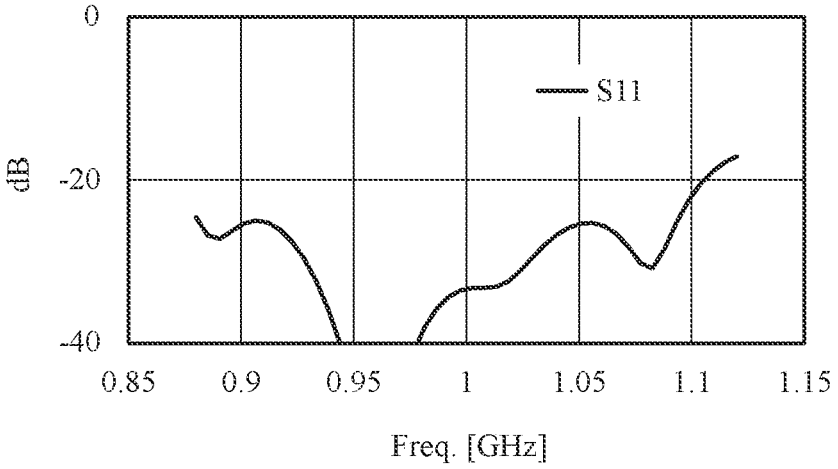
FIG. 5A is an explanatory graph illustrating reflection characteristics at the PORT (1) to which a signal is input.
Figure 5B:
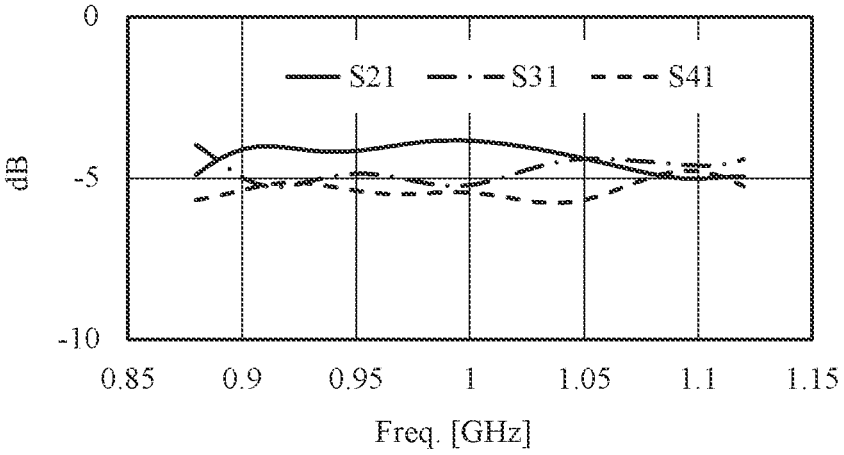
FIG. 5B is an explanatory graph illustrating degree of coupling of signals output from the PORT (2) to the PORT (4), respectively.

FIG. 5A is a diagram illustrating reflection characteristics at the PORT (1) to which a signal is input, and FIG. 5B is a diagram illustrating the degree of coupling of signals output from the PORT (2) to the PORT (4). S21 represents the degree of coupling at the PORT (2), S31 represents the degree of coupling at the PORT (3), and S41 represents the degree of coupling at the PORT (4).

The horizontal axis in each of FIGS. 5A and 5B represents a normalized frequency (f/f0) normalized at a center frequency f0 on the design.

At the PORT (1) to which a signal is input, the reflection is less than or equal to −25 dB in the range of about 0.88 to 1.09 as illustrated in FIG. 5A, and at the PORT (2) to (4) from which signals are output, the degrees of coupling are similar as illustrated in FIG. 5B. Therefore, it is confirmed that the power of the signal input from the PORT (1) is roughly equally divided and output from the PORT (2) to (4).

As is clear from the above, the according to the first embodiment, an input waveguide 6 having one end connected between an L-shaped waveguide 1*a* and an L-shaped waveguide 1*f* and another end connected to the PORT (1); an output waveguide 7 having one end connected between the L-shaped waveguide 1*a* and a flat waveguide 1*b* and another end connected to the PORT (2); an output waveguide 8 having one end connected between the flat waveguide 1*b* and an L-shaped waveguide 1*c* and another end connected to the PORT (3); an output waveguide 9 having one end connected between the L-shaped waveguide 1*c* and an L-shaped waveguide 1*d* and another end connected to the PORT (4); and a plurality of branching waveguides 10 each having one end connected to the output waveguide 7 and another end connected to the output waveguide 8 are provided. Thus, power of a signal can be divided into three without connecting a terminator. Furthermore, there is another effect, which will be described later in detail, that a wiring distance of a signal line can be shortened when mounted on a multibeam forming circuit.

In the first embodiment, the example has been described in which the electrical length of each of the L-shaped waveguide 1*a*, the flat waveguide 1*b*, the L-shaped waveguide 1*c*, the L-shaped waveguide 1*d*, the flat waveguide 1*e*, and the L-shaped waveguide 1*f* is λ/4, and the difference between the sum λ, of the electrical length λ/4 of each of the L-shaped waveguide 1*c*, the L-shaped waveguide 1*d*, the flat waveguide 1*e*, and the L-shaped waveguide 1*f* and the sum λ/2 of the electrical length λ/4 of each of the L-shaped waveguide 1*a* and the flat waveguide 1*b* is λ/2.

However, it is enough for the difference to be a multiple of the electrical length λ/2 by a factor of N (N is an odd number), and the electrical length of each of the L-shaped waveguide 1*a*, the flat waveguide 1*b*, the L-shaped waveguide 1*c*, the L-shaped waveguide 1*d*, the flat waveguide 1*e*, and the L-shaped waveguide 1*f* is not limited to λ/4.

In the first embodiment, the example in which the port 5 is provided between the L-shaped waveguide 1*c* and the L-shaped waveguide 1*d*, and one end of the output waveguide 9 is connected to the port 5 has been described; however, it is enough if the port 2 and the port 5 are apart from each other by an odd multiple of the electrical length λ/4.

Figure 6:
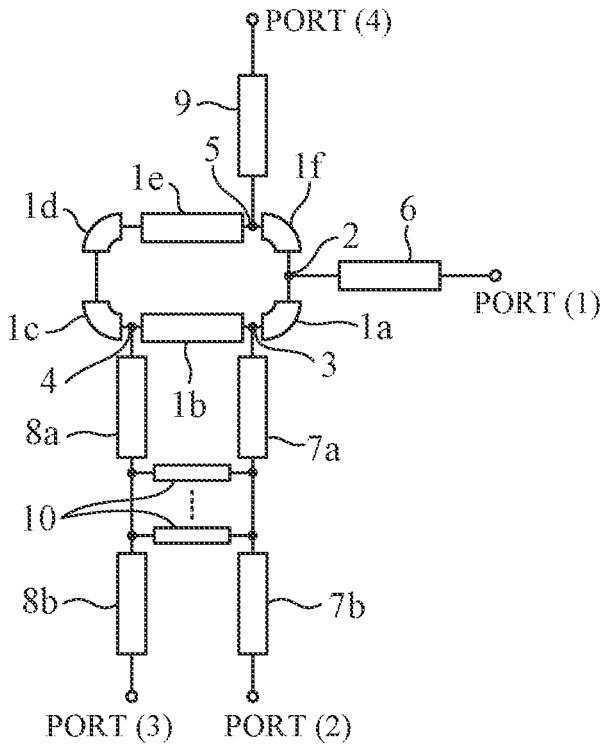
FIG. 6 is an equivalent circuit diagram illustrating another three-way power divider according to the first embodiment of the present invention.

Therefore, as illustrated in FIG. 6, the port 5 may be provided between the flat waveguide 1*e* and the L-shaped waveguide 1*f*, and one end of the output waveguide 9 may be connected to the port 5.

FIG. 6 is an equivalent circuit diagram illustrating another three-way power divider according to the first embodiment of the present invention.

Figure 7:
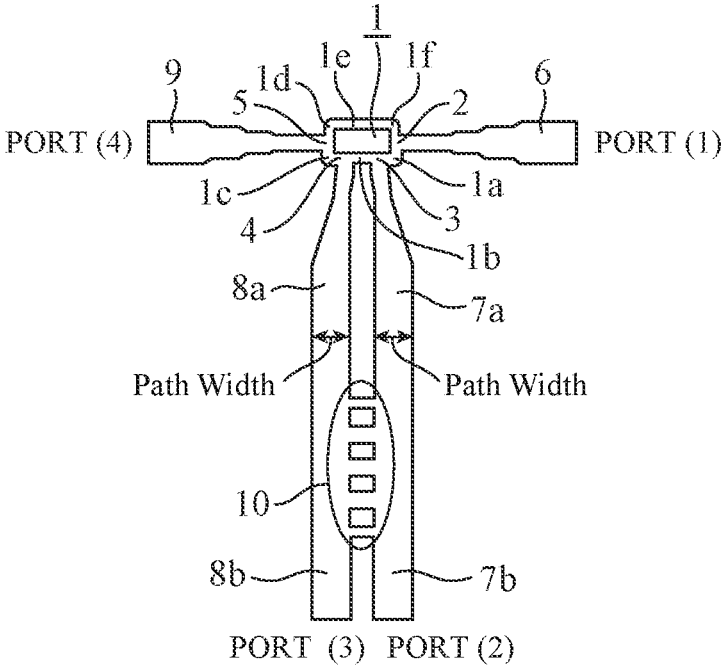
FIG. 7 is a top view illustrating still another three-way power divider according to the first embodiment of the present invention.

In the first embodiment, an example in which a part of the path width of each of the output waveguides 7 and 8 becomes wider stepwise has been described; however, a part of the path width of each of the output waveguides 7 and 8 may become wider to be a tapered shape as illustrated in FIG. 7.

FIG. 7 is a top view illustrating still another three-way power divider according to the first embodiment of the present invention.

In an output waveguide 7, a part of the path width in the vicinity of a port 3 becomes wider to be a tapered shape from the port 3 toward the PORT (2).

Furthermore in an output waveguide 8, a part of the path width in the vicinity of a port 4 becomes wider to be a tapered shape from the port 4 toward the PORT (3).

In the first embodiment, the length of the rectangular waveguide 1 in the direction connecting the PORT (1) and the PORT (4) is short, and thus a sufficient length for connecting the output waveguides 7 and 8 cannot be ensured at the ports 3 and 4. Therefore, a part of the path width of each of the output waveguides 7 and 8 is formed to become wider stepwise or be a tapered shape.

Figure 8:
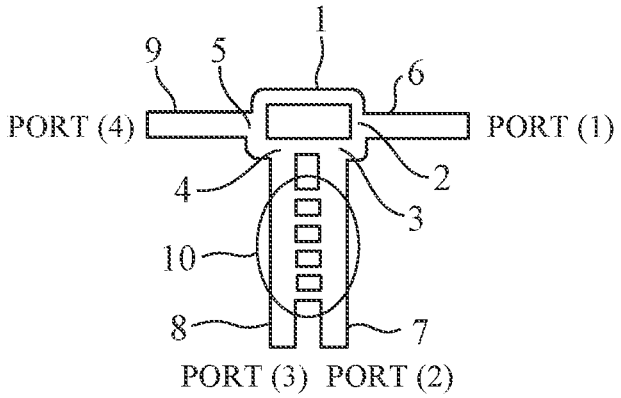
FIG. 8 is a top view illustrating yet another three-way power divider according to the first embodiment of the present invention.

In a case where a sufficient length for connecting the output waveguides 7 and 8 can be ensured at the ports 3 and 4, as illustrated in FIG. 8, a part of the path width of each of the output waveguides 7 and 8 may be constant and may not become wider stepwise or may not be a tapered shape.

FIG. 8 is a top view illustrating yet another three-way power divider according to the first embodiment of the present invention.

In the first embodiment, an example in which a signal is input from the PORT (1) has been described; however, this embodiment is not limited to such an example. A signal may be input from the PORT (4) while the PORT (1) to the PORT (3) output signals.

In this case, the input waveguide 6 is used as an output waveguide, and the output waveguide 9 is used as an input waveguide.

Second Embodiment

In the first embodiment, the output waveguide 8 includes the waveguide 8*a* and the waveguide 8*b*. In a second embodiment, an example in which a resistor that absorbs power is used in place of the waveguide 8*a* will be described.

Figure 9:
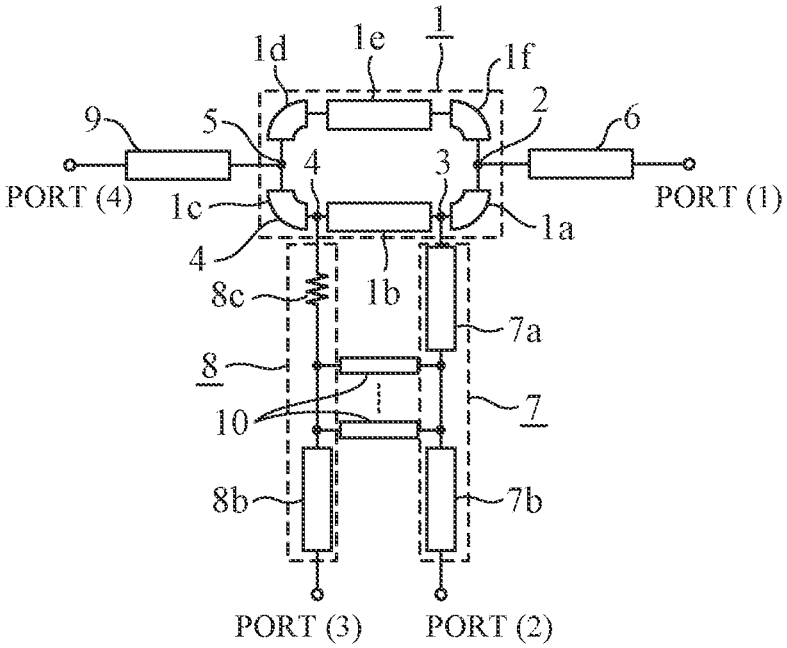
FIG. 9 is an equivalent circuit diagram illustrating a three-way power divider according to a second embodiment of the present invention.

FIG. 9 is an equivalent circuit diagram illustrating a three-way power divider according to the second embodiment of the present invention. In FIG. 9, the same reference numerals as those in FIG. 1 represent the same or corresponding parts and thus descriptions thereof are omitted.

A resistor 8*c* is an absorbing member that absorbs power. An end of the resistor 8*c* is connected to a port 4 of a rectangular waveguide 1 and the other end thereof is connected to one end of a waveguide 8*b*.

In the first embodiment, though little power of a signal flows through the waveguide 8*a* of the output waveguide 8, there is a possibility that a little amount of electric power may flow due to, for example, a manufacturing error or other reasons.

In the second embodiment, since the resistor 8*c* for absorbing power is provided instead of the waveguide 8*a*, even in a case where a little amount of power flows due to a manufacturing error or other reasons, the power can be absorbed by the resistor 8*c*.

As a result, degree of coupling characteristics can be improved as compared with the first embodiment.

Third Embodiment

In the first and second embodiments, examples in which the path width of the flat waveguide 1*e* is the same as the path widths of the L-shaped waveguides 1*d* and 1*f* has been illustrated. In this third embodiment, an example in which the path width of a flat waveguide 1*e* is different from the path widths of the L-shaped waveguides 1*d* and 1*f* will be described.

Figure 10:
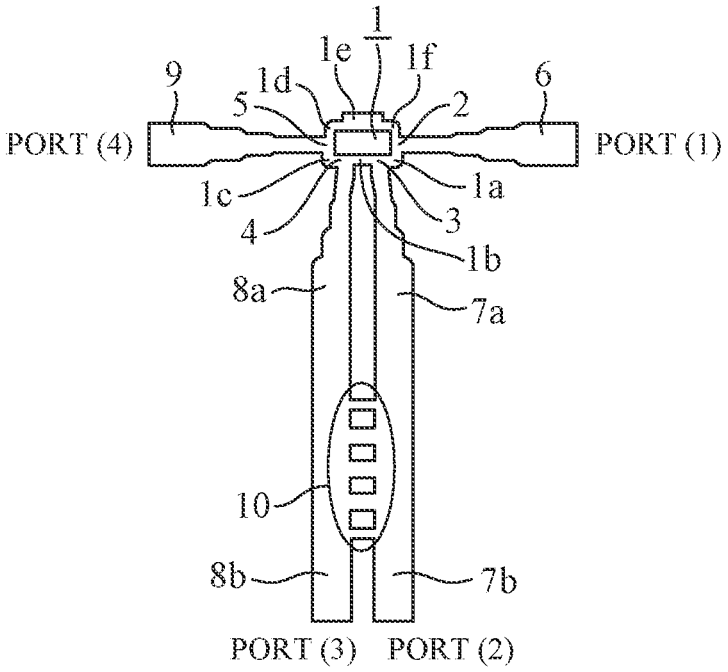
FIG. 10 is a top view illustrating a three-way power divider according to a third embodiment of the present invention.

FIG. 10 is a top view illustrating a three-way power divider according to the third embodiment of the present invention. In FIG. 10, the same reference numerals as those in FIGS. 3, 7, and 8 represent the same or corresponding parts and thus descriptions thereof are omitted.

In the example of FIG. 10, the path width of the flat waveguide 1*e* is wider than the path widths of the L-shaped waveguides 1*d* and 1*f*. The path widths of the flat waveguide 1*e* and the L-shaped waveguides 1*d* and 1*f* is a width in a direction orthogonal to a direction connecting the PORT (1) and the PORT (4) in the rectangular waveguide 1, that is, the width in the vertical direction in the drawing.

By appropriately setting the path width of the flat waveguide 1*e* and the path width of each of the L-shaped waveguides 1*d* and 1*f*, it is possible to adjust, for example, the impedance between the PORT (1) and the PORT (4) to a desired impedance. As a result, the band can be broadened.

Also in the third embodiment, a resistor 8*c* may be used instead of the waveguide 8*a* like in the second embodiment.

Fourth Embodiment

In a fourth embodiment, a multibeam forming circuit mounted with one of the three-way power dividers of the first to third embodiments described above will be explained.

In the fourth embodiment, a multibeam forming circuit that divides power of an input signal and outputs the divided signals from seven output terminals, respectively, will be described.

Figure 11:
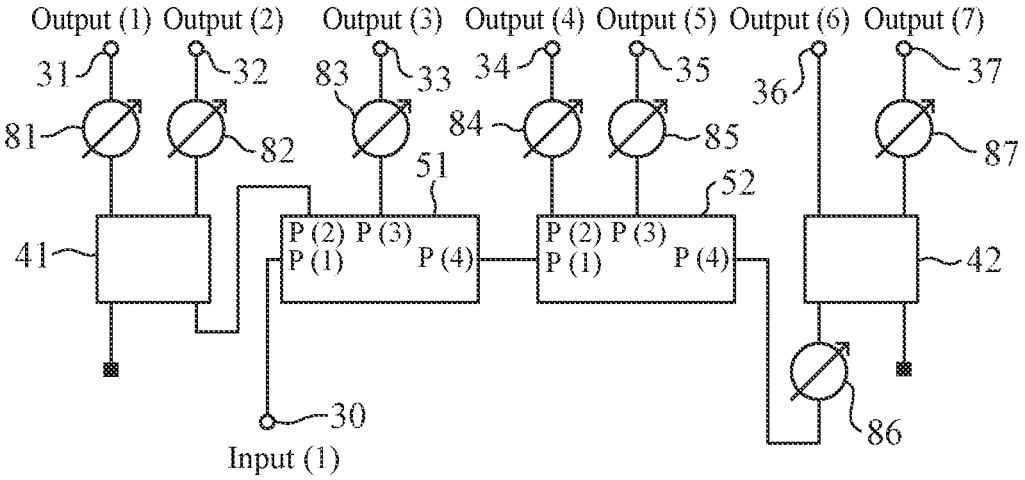
FIG. 11 is a configuration diagram illustrating a multibeam forming circuit in which two pairs of one of the three-way power dividers of the first to third embodiments and a two-way power divider are mounted.

FIG. 11 is a configuration diagram illustrating a multibeam forming circuit in which two three-way power dividers each being any of the first to third embodiments and two two-way power dividers are mounted.

Figure 12:
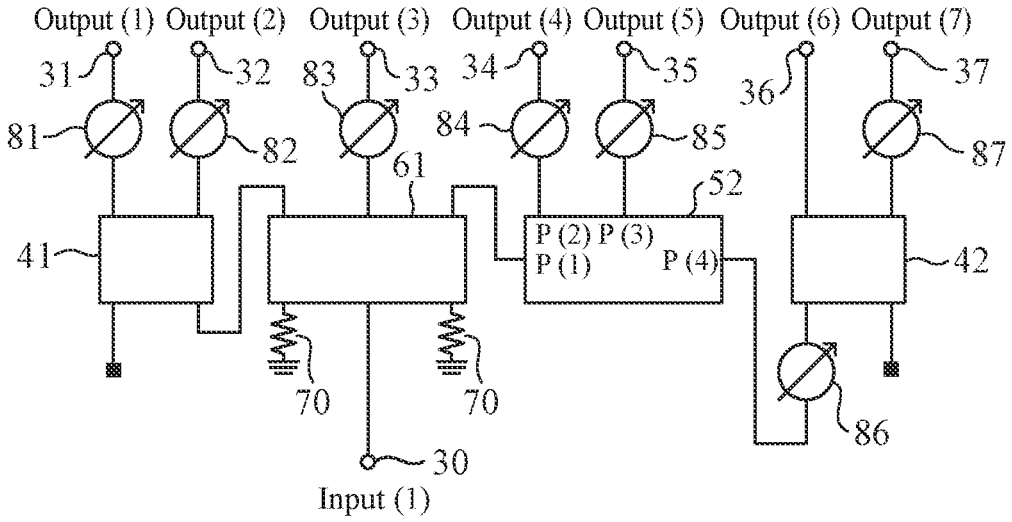
FIG. 12 is a configuration diagram illustrating a multibeam forming circuit in which a three-way power divider being one of the three-way power dividers of the first to third embodiments, a three-way power divider disclosed in Non-Patent Literature 1, and two two-way power dividers are mounted.

FIG. 12 is a configuration diagram illustrating a multibeam forming circuit in which one of the three-way power dividers of the first to third embodiments, a three-way power divider disclosed in Non-Patent Literature 1, and two two-way power dividers are mounted.

Figure 13:
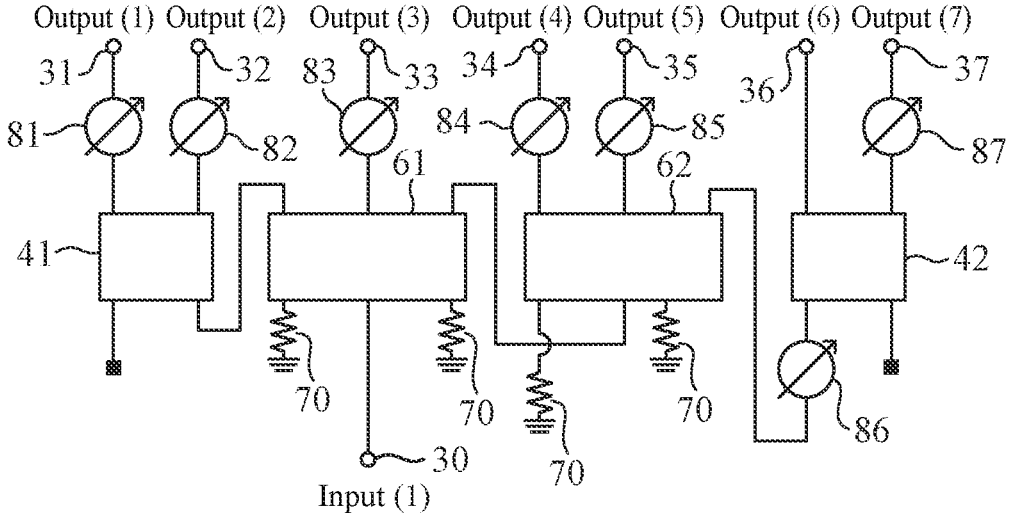
FIG. 13 is a configuration diagram illustrating a multibeam forming circuit in which two three-way power dividers disclosed in Non-Patent Literature 1 and two two-way power dividers are mounted.

FIG. 13 is a configuration diagram illustrating a multibeam forming circuit in which two three-way power dividers disclosed in Non-Patent Literature 1 and two two-way power dividers are mounted.

In FIGS. 11 to 13, an input terminal 30 is a terminal for receiving a signal, and output terminals 31 to 37 are terminals for outputting signals and are connected to radiating elements of an antenna device or the like, respectively, for example. Here, examples in which the number of output terminals 31 to 37 is seven will be described, however, the number of output terminals may be any number as long as it is plural.

Two-way power dividers 41 and 42 each divides power of an input signal into two and outputs the two divided signals.

In the fourth embodiment, one input port in each of the two-way power dividers 41 and 42 is provided on the lower side in the figure, and two output ports in each of the two-way power dividers 41 and 42 are provided on the upper side.

Each of three-way power dividers 51 and 52 is any one of the three-way power dividers of the first to third embodiments. In the figure, P (1) corresponds to the PORT (1) illustrated in the first to third embodiments, P (2) corresponds to the PORT (2) illustrated in the first to third embodiments, P (3) corresponds to the PORT (3) illustrated in the first to third embodiments, and P (4) corresponds to the PORT (4) illustrated in the first to third embodiments.

Each of three-way power dividers 61 and 62 is the three-way power divider disclosed in Non-Patent Document 1, and two terminators 70 are connected to them.

In the fourth embodiment, one input port in each of the three-way power dividers 61 and 62 is provided on the lower side in the figure, and three output ports in each of the three-way power dividers 61 and 62 are provided on the upper side.

The phase shifters 81 to 87 are devices for changing the phase of a signal.

Next, the operation will be described.

In the multibeam forming circuit illustrated in FIGS. 11 to 13, two two-way power dividers 41 and 42 and two three-way power dividers are arranged in the lateral direction in the figures in order to shorten the length in a waveguide axial direction orthogonal to an aligned direction of a plurality of radiating elements. The waveguide axial direction corresponds to the vertical direction in the figures.

As illustrated below, the multibeam forming circuits of FIGS. 11 to 13 each divides power of a signal input from an input terminal 30 and outputs the divided signals to output terminals 31 to 37, and thus the operation itself of each of them is the same.

In the multibeam forming circuit of FIG. 13, a signal input from the input terminal 30 is input to the three-way power divider 61, and three signals divided by the three-way power divider 61 are respectively input to the two-way power divider 41, the three-way power divider 62, and the phase shifter 83.

The signal output from the three-way power divider 61 to the two-way power divider 41 is divided into two by the two-way power divider 41, and the two divided signals are respectively output to the phase shifters 81 and 82.

The signal output from the three-way power divider 61 to the three-way power divider 62 is divided into three by the three-way power divider 62, and the three divided signals are respectively output to phase shifters 84, 85, and 86.

The signal passed through the phase shifter 86 is divided into two by the two-way power divider 42, and the two divided signals are respectively output to an output terminal 36 and the phase shifter 87.

In the multibeam forming circuit of FIG. 12, a signal input from the input terminal 30 is input to the three-way power divider 61, and three signals divided by the three-way power divider 61 are respectively input to the two-way power divider 41, a three-way power divider 52, and the phase shifter 83.

The signal output from the three-way power divider 61 to the two-way power divider 41 is divided into two by the two-way power divider 41, and the two divided signals are respectively output to the phase shifters 81 and 82.

The signal output from the three-way power divider 61 to the three-way power divider 52 is divided into three by the three-way power divider 52, and the three divided signals are respectively output to the phase shifters 84, 85, and 86.

The signal passed through the phase shifter 86 is divided into two by the two-way power divider 42, and the two divided signals are respectively output to the output terminal 36 and the phase shifter 87.

In the multibeam forming circuit of FIG. 11, a signal input from the input terminal 30 is input to the three-way power divider 51, and three signals divided by the three-way power divider 51 are respectively input to the two-way power divider 41, the three-way power divider 52, and the phase shifter 83.

The signal output from the three-way power divider 51 to the two-way power divider 41 is divided into two by the two-way power divider 41, and the two divided signals are respectively output to the phase shifters 81 and 82.

The signal output from the three-way power divider 51 to the three-way power divider 52 is divided into three by the three-way power divider 52, and the three divided signals are respectively output to the phase shifters 84, 85, and 86.

The signal passed through the phase shifter 86 is divided into two by the two-way power divider 42, and the two divided signals are respectively output to the output terminal 36 and the phase shifter 87.

In the multibeam forming circuit illustrated in FIG. 13, since output ports of the three-way power divider 61 are on the upper side and an input port of the three-way power divider 62 is on the lower side, a wiring distance of a signal line connecting the three-way power divider 61 and the three-way power divider 62 is long.

Furthermore, since output ports of the three-way power divider 62 are on the upper side and an input port of the two-way power divider 42 is on the lower side, a wiring distance of a signal line connecting the three-way power divider 62 and the two-way power divider 42 is long.

In the multibeam forming circuit of FIG. 12, since output ports of the three-way power divider 61 are on the upper side and an input port of the three-way power divider 52 is on the left side, a wiring distance of a signal line connecting the three-way power divider 61 and the three-way power divider 52 is shorter as compared to the signal line connecting the three-way power divider 61 and the three-way power divider 62 in FIG. 13.

Furthermore, since an output port of the three-way power divider 52 is on the right side and an input port of the two-way power divider 42 is on the lower side, a wiring distance of a signal line connecting the three-way power divider 52 and the two-way power divider 42 is shorter as compared to the signal line connecting the three-way power divider 62 and the two-way power divider 42 in FIG. 13.

In the multibeam forming circuit of FIG. 11, since an output port of the three-way power divider 51 is on the right side and an input port of the three-way power divider 52 is on the left side, a wiring distance of a signal line connecting the three-way power divider 51 and the three-way power divider 52 is shorter as compared to the signal line connecting the three-way power divider 61 and the three-way power divider 62 in FIG. 13.

Furthermore, since an output port of the three-way power divider 52 is on the right side and an input port of the two-way power divider 42 is on the lower side, a wiring distance of a signal line connecting the three-way power divider 52 and the two-way power divider 42 is shorter as compared to the signal line connecting the three-way power divider 62 and the two-way power divider 42 in FIG. 13.

As is apparent from the above, according to the fourth embodiment, since the multibeam forming circuit is mounted with one of the three-way power dividers of the first to third embodiments described above, a wiring distance of a signal line can be shortened.

Figure 14:
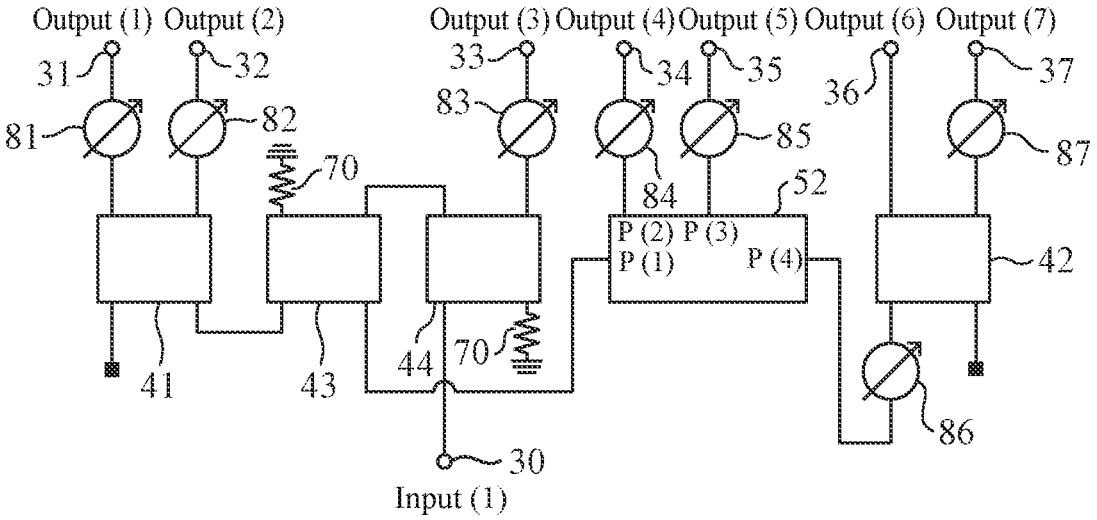
FIG. 14 is a configuration diagram illustrating a multibeam forming circuit in which four two-way power dividers and one three-way power divider are mounted.

In the fourth embodiment, the multibeam forming circuit in which two two-way power dividers 41 and 42 and two three-way power dividers are arranged in the lateral direction has been described; however, this embodiment is not limited to such examples. For example, as illustrated in FIG. 14, in a multibeam forming circuit, four two-way power dividers 41, 42, 43, and 44 and one three-way power divider 52 may be arranged in the lateral direction.

Note that, within the scope of the present invention, embodiments of the present invention can be freely combined and any component of the respective embodiments can be modified or omitted.

INDUSTRIAL APPLICABILITY

The present invention is suitable for a three-way power divider for dividing power of an input signal into three. The present invention is also suitable for a multibeam forming circuit mounted with the three-way power divider.

REFERENCE SIGNS LIST

1: Rectangular waveguide, 1*a*: L-Shaped waveguide (first L-shaped waveguide), 1*b*: Flat waveguide (first flat waveguide), 1*c*: L-shaped waveguide (second L-shaped waveguide), 1*d*: L-shaped waveguide (third L-shaped waveguide), 1*e*: Flat waveguide (second flat waveguide), 1*f*: L-shaped waveguide (fourth L-shaped waveguide), 2: Port, 3: Port, 4: Port, 5: Port, 6: Input waveguide, 7: Output waveguide (first output waveguide), 7*a*, 7*b*: Waveguide, 8: Output waveguide (second output waveguide), 8*a*, 8*b*: Waveguide, 8*c*: Resistor, 9: Output waveguide (third output waveguide), 10: Branching waveguide, 30: Input terminal, 31 to 37: Output terminal, 41, 42, 43, 44: Two-way power divider, 51, 52: Three-way power divider, 61, 62: Three-way power divider, 70: Terminator, 81 to 87: Phase shifter.

The invention claimed is:

1. A three-way power divider, comprising:

a rectangular waveguide having a waveguide wall, the waveguide wall being formed by a first L-shaped waveguide, a first flat waveguide, a second L-shaped waveguide, a third L-shaped waveguide, a second flat waveguide, and a fourth L-shaped waveguide arranged in a ring shape;

an input waveguide having one end connected between the first L-shaped waveguide and the fourth L-shaped waveguide and another end connected to a first port;

a first output waveguide having one end connected between the first L-shaped waveguide and the first flat waveguide and another end connected to a second port;

a second output waveguide having one end connected between the first flat waveguide and the second L-shaped waveguide and another end connected to a third port;

a third output waveguide having one end connected between the second L-shaped waveguide and the third L-shaped waveguide, or between the second flat waveguide and the fourth L-shaped waveguide and another end connected to a fourth port; and a plurality of branching waveguides each having one end connected to the first output waveguide and another end connected to the second output waveguide.

2. The three-way power divider according to claim 1, wherein a difference between a sum of electrical lengths of the second L-shaped waveguide, the third L-shaped waveguide, the second flat waveguide, and the fourth L-shaped waveguide and a sum of electrical lengths of the first L-shaped waveguide and the first flat waveguide is a multiple of a half of a wavelength of a propagating signal by a factor of N (N is an odd number) at a frequency of a fundamental wave of the propagating signal.

3. The three-way power divider according to claim 2, wherein a difference between a sum of electrical lengths of the third L-shaped waveguide, the second flat waveguide, and the fourth L-shaped waveguide and a sum of electrical lengths of the first flat waveguide and the second L-shaped waveguide is a multiple of a quarter of a wavelength of the signal by a factor of M (M is an odd number) at the frequency of the fundamental wave of the signal.

4. The three-way power divider according to claim 1, wherein a part of a path width of the first output waveguide becomes wider stepwise from one end toward the other end, and a part of a path width of the second output waveguide becomes wider stepwise from one end toward the other end.

5. The three-way power divider according to claim 1, wherein a part of a path width of the first output waveguide becomes wider to form a tapered shape from one end toward the other end, and a part of a path width of the second output waveguide becomes wider to form a tapered shape from one end toward the other end.

6. The three-way power divider according to claim 1, further comprising a resistor to absorb power arranged in a part of the second output waveguide.

7. The three-way power divider according to claim 1, wherein a path width of the second flat waveguide is different from path widths of the third L-shaped waveguide and the fourth L-shaped waveguide.

8. A multibeam forming circuit mounted with a three-way power divider, wherein the three-way power divider comprises:

a rectangular waveguide having a waveguide wall, the waveguide wall being formed by a first L-shaped waveguide, a first flat waveguide, a second L-shaped waveguide, a third L-shaped waveguide, a second flat waveguide, and a fourth L-shaped waveguide arranged in a ring shape;

an input waveguide having one end connected between the first L-shaped waveguide and the fourth L-shaped waveguide and another end connected to a first port;

a first output waveguide having one end connected between the first L-shaped waveguide and the first flat waveguide and another end connected to a second port;

a second output waveguide having one end connected between the first flat waveguide and the second L-shaped waveguide and another end connected to a third port;

a third output waveguide having one end connected between the second L-shaped waveguide and the third L-shaped waveguide, or between the second flat waveguide and the fourth L-shaped waveguide and another end connected to a fourth port; and a plurality of branching waveguides each having one end connected to the first output waveguide and another end connected to the second output waveguide.

* * * * *